US006932490B2

(12) United States Patent
Emil et al.

(10) Patent No.: US 6,932,490 B2
(45) Date of Patent: Aug. 23, 2005

(54) LED FLASHLIGHT

(75) Inventors: Chan Ka Ming Emil, Sunshine (HK); Hon Siu Cheong Ellis, Sunshine (HK)

(73) Assignee: The Brinkmann Corporation, Dallas, TX (US)

( * ) Notice: Subject to any disclaimer, the term of this patent is extended or adjusted under 35 U.S.C. 154(b) by 0 days.

(21) Appl. No.: 10/606,118

(22) Filed: Jun. 25, 2003

(65) Prior Publication Data

US 2004/0160765 A1 Aug. 19, 2004

Related U.S. Application Data

(63) Continuation of application No. 09/637,344, filed on Aug. 11, 2000, now abandoned.

(51) Int. Cl.[7] ..... F21L 4/04

(52) U.S. Cl. ..... 362/202; 362/200; 362/308; 362/328; 257/98

(58) Field of Search ..... 362/200, 201, 362/202, 204, 205, 208, 800, 240, 241, 308, 309, 310, 336, 346, 311, 327, 328, 307; 359/721; 257/98

(56) References Cited

U.S. PATENT DOCUMENTS

| | | | | | |
|---|---|---|---|---|---|
| 1,219,583 | A | | 3/1917 | Perry | |
| 2,362,176 | A | | 11/1944 | Swanson | |
| 2,469,080 | A | | 5/1949 | Rosin et al. | |
| 4,336,580 | A | * | 6/1982 | Mouyard et al. | 362/347 |
| 4,530,040 | A | | 7/1985 | Petterson | |
| 4,698,730 | A | | 10/1987 | Sakai et al. | |
| 4,733,335 | A | | 3/1988 | Serizawa et al. | |
| 4,853,531 | A | * | 8/1989 | Rejc | 250/221 |
| 4,920,404 | A | * | 4/1990 | Shrimali et al. | 257/98 |
| 4,920,469 | A | | 4/1990 | Harding | |
| 5,093,768 | A | | 3/1992 | Ohe | |
| 5,490,045 | A | | 2/1996 | Lindner | |
| 5,534,718 | A | * | 7/1996 | Chang | 257/98 |
| 5,698,866 | A | * | 12/1997 | Doiron et al. | 257/99 |
| 5,803,579 | A | * | 9/1998 | Turnbull et al. | 362/516 |
| 5,894,196 | A | | 4/1999 | McDermott | |
| 6,220,719 | B1 | | 4/2001 | Vetorino et al. | |
| 6,244,723 | B1 | * | 6/2001 | Talamo | 362/208 |
| 6,260,994 | B1 | * | 7/2001 | Matsumoto et al. | 362/574 |
| 6,361,190 | B1 | * | 3/2002 | McDermott | 362/310 |
| 6,585,391 | B1 | * | 7/2003 | Koch et al. | 362/205 |
| 6,686,691 | B1 | * | 2/2004 | Mueller et al. | 313/503 |
| 6,814,463 | B2 | | 11/2004 | Mele | |

FOREIGN PATENT DOCUMENTS

| | | | |
|---|---|---|---|
| GB | 810256 | * | 5/1959 |

* cited by examiner

*Primary Examiner*—Stephen Husar
*Assistant Examiner*—Hargobind S. Sawhney
(74) *Attorney, Agent, or Firm*—Sheppard, Mullin, Richter & HamptonLLP

(57) ABSTRACT

A flashlight configured to durably provide an effective beam of light for extended periods of time. The flashlight features a high-power, directed LED configured to produce a divergent beam of light that is characterized by an optical directivity angle extending from a vertex point. The flashlight includes a lens having a first portion forming a convergent lens, where the LED is located such that its vertex point coincides with the lens' focal point. The convergent lens is sized and positioned such that substantially all of the directed light from the LED passes through the convergent lens portion to emerge in a first beam of parallel light. The LED emits additional light through a tip. A parabolic reflector has the tip at its focal point to reflects the additional light into a second beam of parallel light that is parallel to and surrounding the first beam, thus forming a single and more efficient useful beam. The LED and parabolic reflector are formed into an illuminator assembly that is contained within a housing of the flashlight so as to hold the LED in alignment with its preferred position with respect to the parabolic reflector.

17 Claims, 5 Drawing Sheets

FIG. 8

Characteristics

- High Power LEDs
- Half Angle ( $2\theta_{1/2}$ ) : 20°
- Superior Weather-resistance
- UV Resistant Epoxy

Applications

- Advertising Signs
- Indicators
- LCD Back Lights
- Illuminations

Directivity

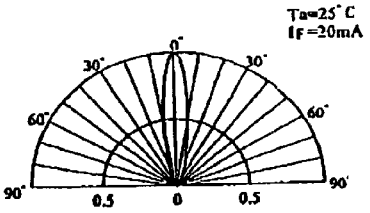

Absolute Maximum Rating (Ta = 25℃)

| Item | Symbol | Absolute Maximum Rating | Unit |
|---|---|---|---|
| DC Forward Current | IF | 30 | mA |
| Pulse Forward Current ※ | IFP | 100 | mA |
| Reverse Voltage | VR | 5 | V |
| Power Dissipation | PD | 120 | mW |
| Operating Temperature | Topr | -30 ~ +85 | ℃ |
| Storage Temperature | Tstg | -40 ~ +100 | ℃ |

※ Pulse width Max.10ms Duty ratio Max 1/10

Electrical· Optical Characteristics (Ta = 25℃)

| Item | Symbol | Condition | Min. | Typ. | Max. | Unit |
|---|---|---|---|---|---|---|
| DC Forward Voltage | VF | IF=20mA | - | 3.6 | 4.0 | V |
| DC Reverse Current | IR | VR=5V | - | - | 50 | μA |
| Luminous Intensity | Iv | IF=20mA | - | 5.60 | - | cd |
| Chromaticity Coordinate※ | x | IF=20mA | - | 0.31 | - | - |
| Chromaticity Coordinate※ | y | IF=20mA | - | 0.32 | - | - |

※ Please refer to CIE 1931 chromaticity diagram.

Outline Dimension

Tolerance : ±0.2
Unit :mm

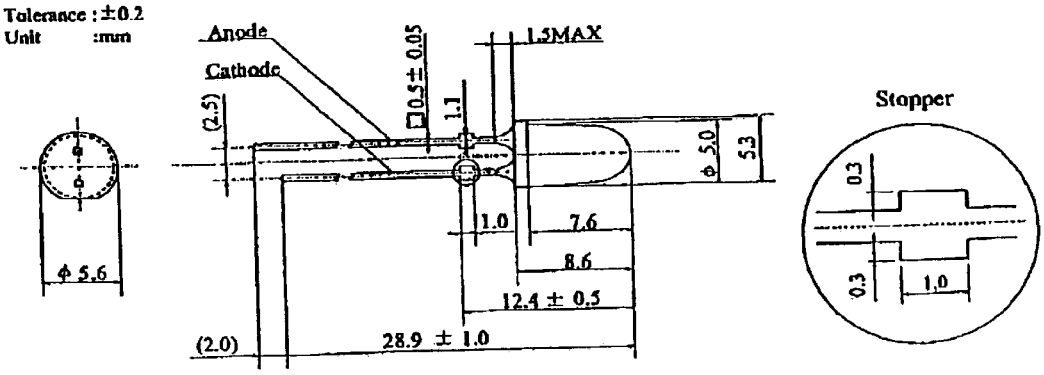

LED FLASHLIGHT

This is a continuation of U.S. patent application Ser. No. 09/637,344, filed Aug. 11, 2000, which has been abandoned.

BACKGROUND OF THE INVENTION

The present invention pertains to the field of portable or battery-operated lighting products. More particularly, this invention relates to hand-held, battery operated flashlights.

Flashlights are used to cover a variety of household, workplace and recreational needs. Common-flashlights often include a head that contains a relatively fragile incandescent bulb, and a cylindrical body configured to hold batteries. A switch, commonly mounted in the body, completes a circuit between the batteries and the bulb. A parabolic mirror or reflector is located within the head, with the filament(s) of the bulb positioned at the focal point of the mirror. The mirror directs rays of light from the filament forward in a parallel direction, creating a useful beam, as depicted in FIG. 1A. In some cases, such flashlights are provided with rubber o-rings to form a water-tight seal on the flashlight.

Many flashlights are stored without usage for great periods of time, and can be then called upon to provide light for long periods with little notice. Other flashlights are used frequently, and can be subject to significant environmental extremes such as shock and temperature. In either case, failure of the flashlight's fragile bulb is an all-to-frequent occurrence, leaving a user without a useful light source. Time efficiency often dictates that the entire flashlight, rather than just the bulb, be replaced, making the loss of a bulb relatively expensive.

As much as 50% of the light produced by the filament will miss the parabolic mirror (in either a forward or rearward direction), causing a large portion of the light to be widely radiated out in many directions, as depicted in FIG. 1B. While this peripheral light is sometimes useful, it is nothing but wasted glare in many situations. Other common problems experienced by such flashlights include batteries that do not provide light for an adequately extended period, particularly after the flashlight has been in use or in storage. A further problem is that if the bulb filaments are not precisely positioned at the focal point of the parabolic mirror, the light striking the mirror will not be directed in a parallel beam, further reducing the effectiveness and efficiency of the flashlight.

Accordingly, there has existed a definite need for a durable flashlight configured to provide, an effective useful beam for an extended period, particularly after extended storage. The present invention satisfies these and other needs, and provides further related advantages.

SUMMARY OF THE INVENTION

The present invention provides a flashlight configured to durably provide an effective useful beam of light for extended periods. The flashlight will typically have low power requirements, and will therefore last for extended periods on a given set of batteries. Because of the low power requirements, it will generally function on the limited power available after a battery has been stored for an extended period.

The flashlight features a high-power, directed LED configured to produce a divergent beam of light characterized by an optical directivity angle extending from a vertex point. Because the flashlight preferably derives all its illumination from the LED, the flashlight will typically have low power requirements and be significantly more durable than a flashlight deriving its light from an incandescent bulb.

Another feature of the invention is that the flashlight includes a lens having a first portion that is convergent, where the LED is located such that its vertex point coincides with the lens' focal point. This feature provides for the divergent beam of light to be focused into a useful beam of parallel light, providing for efficient use of the often-limited light available from an LED. Preferably, the convergent lens is sized and positioned such that substantially all of the directed light from the LED passes through the convergent lens portion to emerge in a first beam of parallel light.

Yet another feature of the invention is that the flashlight also includes a parabolic reflector. The LED emits additional light through a tip, and the tip is located at a focal point of the parabolic reflector. An advantage of this feature is that at least some, or preferably a substantial portion of the additional light strikes the parabolic reflector to form a second beam of parallel light. The second beam of parallel light preferably passes through a preferably flat lens that does not change the overall direction of the second beam. The second beam is preferably parallel to and surrounding the first beam, thus forming a single and more efficient useful beam.

The invention also features an illuminator assembly contained within a housing of the flashlight. The illuminator assembly includes both the LED and the parabolic reflector. This feature advantageously provides for the LED to be held substantially in its preferred position with respect to the parabolic reflector.

Other features and advantages of the invention will become apparent from the following detailed description of the preferred embodiments, taken with the accompanying drawings, which illustrate, by way of example, the principals of the invention.

BRIEF DESCRIPTION OF THE DRAWINGS

FIG. 8 presents specifications of a preferred LED

DETAILED DESCRIPTION OF THE PREFERRED EMBODIMENTS

Figure 1B:
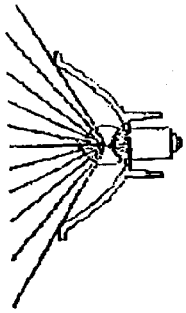
FIG. 1B PRIOR ART
FIG. 1B is a schematic representation of wasted glare produced by a typical bulb in an ordinary, prior-art flashlight.
Figure 1A:
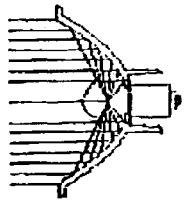
FIG. 1A PRIOR ART
FIG. 1A is a schematic representation of a useful beam produced by a typical bulb in an ordinary, prior-art flashlight.

A flashlight 10 according to the present invention is shown in FIGS. 2, 3A–3C and 4A–4B. The flashlight includes a front housing portion 12, a lens 14, an illuminator assembly 16, a body portion 18, a switch assembly 20 and a rear housing portion 22. The front housing portion is a hollow, approximately cylindrical tube with a forward-facing orifice 30 at a front end 32 and a threaded, rearward-facing opening 34 at a rear end 36. The rear housing portion is a hollow, approximately cylindrical tube with a threaded, forward-facing opening 40 at a front end 42 and a rearward facing orifice 44 at a rear end 46. The rear end of the front housing portion and the front end of the rear housing portion are configured to threadedly engage each other, forming a cylindrical, hollow housing to contain the lens, illuminator assembly, body portion and switch assembly.

The flashlight 10 is configured with a first rubber o-ring 50 conformingly received between the lens 16 and the front end 32 of the front housing portion 12, to form a watertight seal over the forward-facing orifice 30. Likewise, the flashlight 10 is configured with a rubber cap 52 conformingly received between the lens switch assembly 20 and the rear end 46 of the rear housing portion 22, to form a watertight seal over the rearward-facing orifice 44. Additionally, the flashlight is configured with a second o-ring 54 between the rear end 36 of the front housing portion and the front end 42 of the rear housing portion 22, forming a watertight seal between the front and rear housing portions. Thus, the housing (i.e., the combined front and rear housing portions) is watertight.

Figure 5:
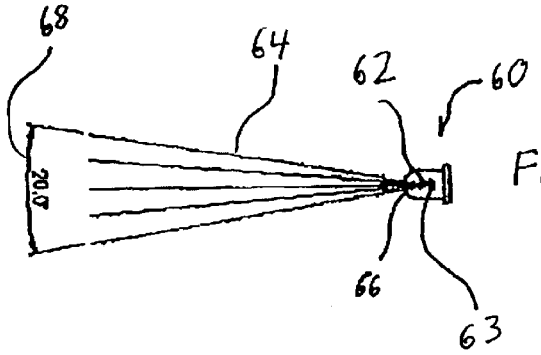
FIG. 5 is a side elevational view of a directional LED used in the flashlight depicted in FIG. 2.
Figures 3A, 3B, 3C, 4A, 4B:
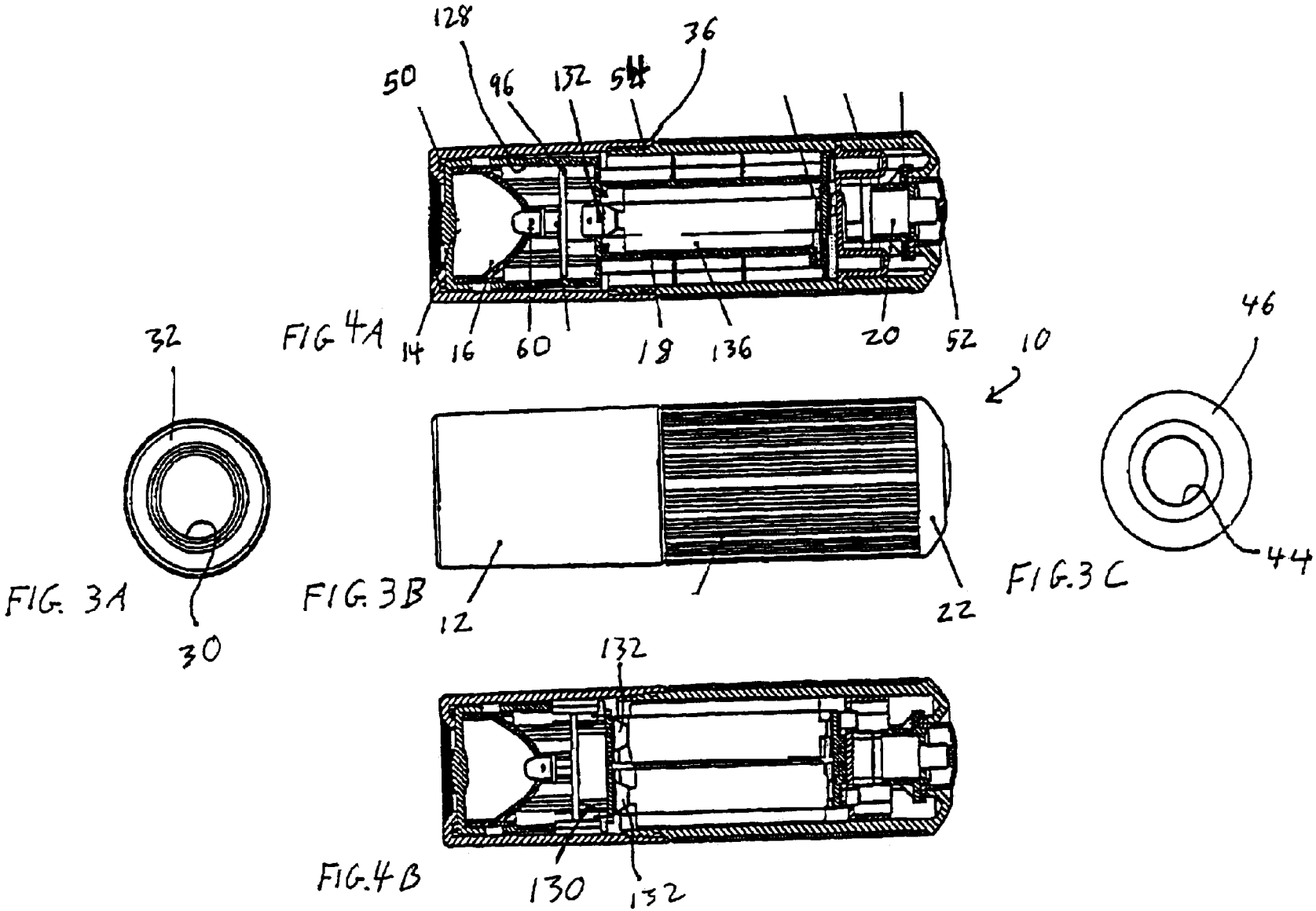
FIG. 3A is a front elevational view of the flashlight depicted in FIG. 2.
FIG. 3B is a side elevational view of the flashlight depicted in FIG. 2.
FIG. 3C is a rear elevational view of the flashlight depicted in FIG. 2.
FIG. 4A is a plan cross-section view of the flashlight depicted in FIG. 2.
FIG. 4B is an elevational cross-section view of the flashlight depicted in FIG. 2.

With reference to FIGS. 4A, 4B and 5, the illuminator assembly 16 has a high-power, white LED 60. Preferably the LED is the only light source in the flashlight, as preferably no bulb is present. The LED has a filament 62 that produces rays of light when energized. The LED also has a built-in, parabolic micro-reflector 63 that directs a significant portion (preferably more than 50%) of the filaments light rays in a divergent beam 64 from a vertex point through a transparent tip 66 of the LED over a directivity angle 68, preferably of 20 degrees. The vertex point is normally the location of the filament. Preferably around 10% of the light from the filament is emitted directly into the divergent beam without first reflecting off the micro reflector.

A preferred LED is the High-power White LED, NSPW500BS, by NICHIA CORPORATION of Japan. It includes stoppers to aid in positioning the LED, and has a preferred electrical and optical characteristics, as well as preferred light directivity. The characteristics of the High-power White LED, NSPW500BS, by NICHIA CORPORATION are depicted in FIG. 8.

Figure 6A:
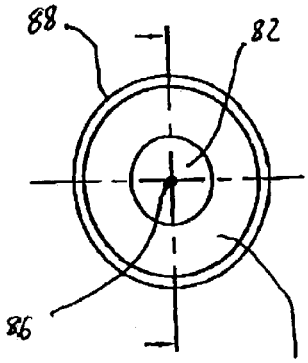
FIGS. 6A and 6B are front and side elevational views, respectively, of a lens used in the flashlight depicted in FIG. 2.
Figure 6B:
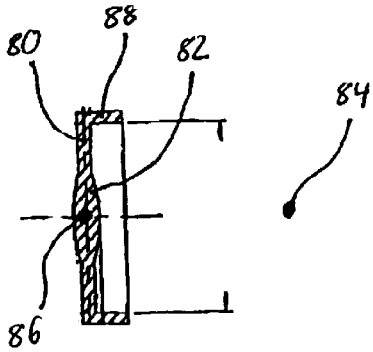

With reference to FIGS. 6A and 6B, the lens 14 is a transparent body having a circular flat portion 80 surrounding a concentric, circular, convergent-lens portion 82. The convergent-lens portion forms a biconvex lens having a focal point 84 on each side of the convergent-lens portion, each focal point being a focal distance away from a focal center point 86 of the convergent-lens portion. A flange 88 surrounds the flat portion 80, adding rigidity to the lens in the vicinity where it will compress the first o-ring 50 against the forward end 32 of the front housing portion 12 (see, FIG. 2). Preferably the lens is made of acrylic plastic by injection molding.

Figure 2:
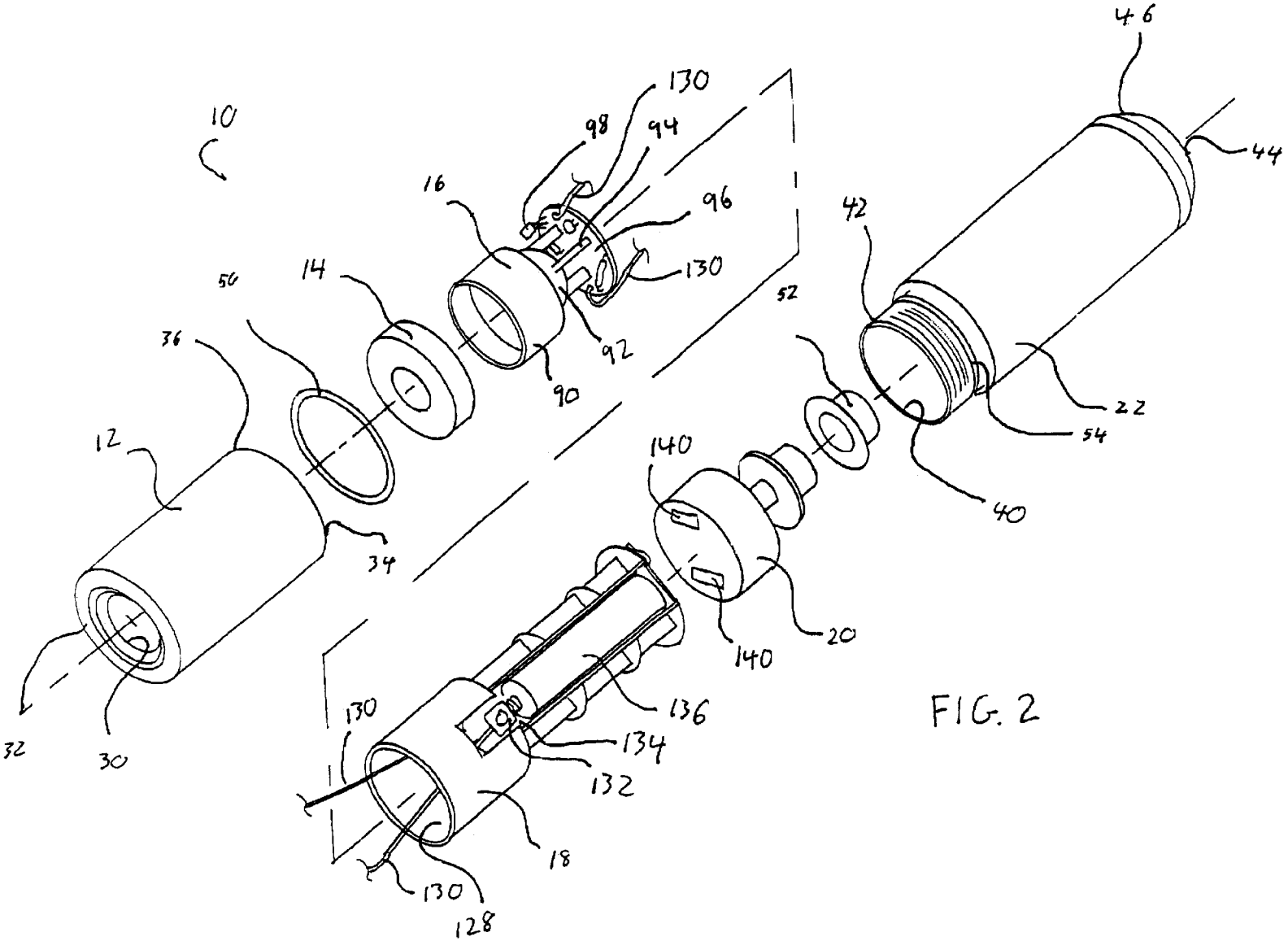
FIG. 2 is an exploded perspective view of a flashlight embodying features of the present invention.
Figure 7A:
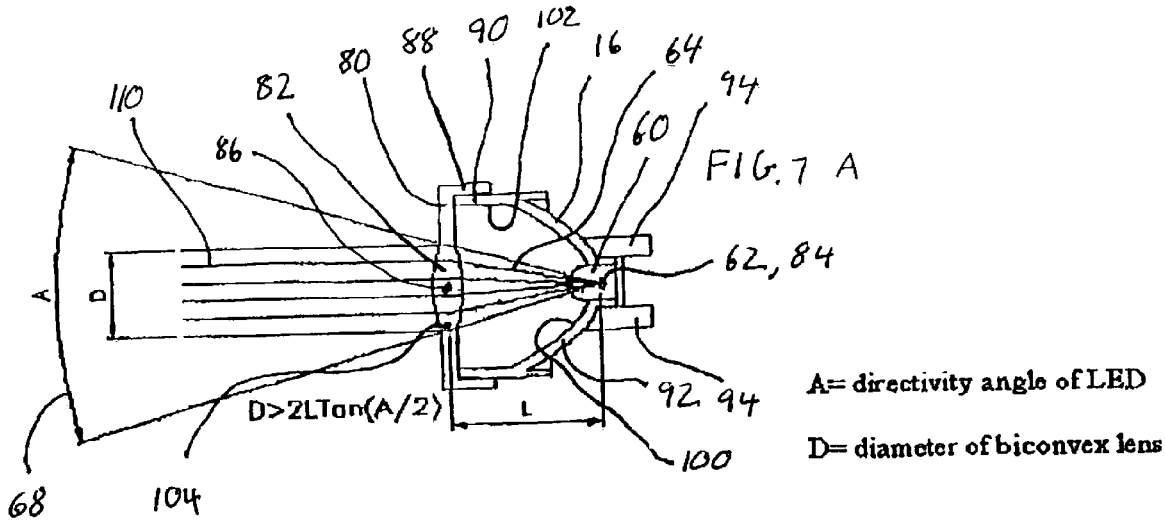
FIG. 7A is a side elevational view of a forward portion of the flashlight used in the flashlight depicted in FIG. 2, depicting the directed light from the LED being made parallel by the lens.

As depicted in FIGS. 2 and 7A, besides the LED 60, the illuminator assembly 16 includes a flange 90, a parabolic portion 92, support legs 94, and a printed circuit board 96 associated circuitry 98 configured to make the LED compatible with battery power levels that are available in the flashlight. A parabolic inner face 100 of the parabolic portion 92 is a reflective, preferably mirror-like surface, having a focal point. Likewise, an inner face 102 of the illuminator assembly's flange 90 is a reflective, preferably mirror-like surface.

The illuminator assembly's flange 90 is sized and shaped to be conformingly received within the lens' flange 88 and against a peripheral portion of the lens' circular flat portion 80, thereby serving to position the LED 60 with respect to the lens' convergent-lens portion 82. In particular, the LED's filament 62 is positioned at the focal point 84 of the convergent-lens portion 82, and the divergent beam 64 is centered on the focal center point 86 of the lens. Additionally, the convergent-lens portion 82 is sized such that the outer limits of the beam preferably pass through the convergent-lens portion, and most preferably through a periphery 104 of the convergent-lens portion. In other words, the relationship between the diameter of the convergent-lens portion D, the focal distance L, and the directivity angle 68 is preferably stated as follows:

$$D \geqq 2L\mathrm{Tan}(A/2)$$

Most preferably the above equation is an equality. As a result of the above-described configuration, a divergent beam 64 produced by the LED 60 will pass through the convergent-lens portion 82 to become a first parallel beam 110 of light, having a diameter of D, as shown in FIG. 7A.

Figure 7B:
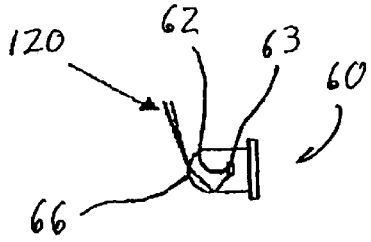
FIG. 7B is a side elevational view of nondirected light being emitted by a directional LED due to internal reflection.

As seen in FIG. 7B, some light emitted by the LED's filament 62 does not get directed by the micro reflector 63 into the divergent beam, and does not enter the divergent beam directly. Instead, after total internal reflection, it reaches the transparent tip 66 and exits the LED 60 in a direction extending, outside the divergent beam. This is typically accented by passing through the tip at an angle not normal to the surface of the tip at that location, causing the light to refract to an angle further outside the divergent beam.

Figure 7C:
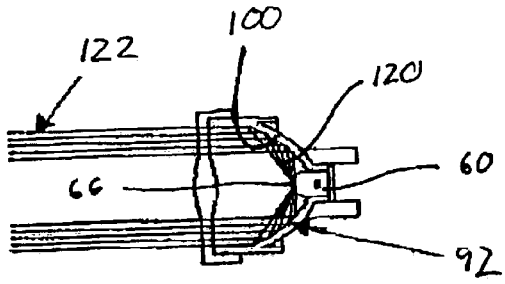
FIG. 7C is a side elevational, view of a forward portion of the flashlight used in the flashlight depicted in FIG. 2, depicting a significant portion of the emitted non-directional light being made parallel by a parabolic mirror.

With reference to FIGS. 7B and 7C, a, significant portion of this side-emitted light 120 extends from the tip 66 of the LED 60 toward the reflective inner face 100 of the parabolic portion 92. The illuminator assembly 16 is configured such that the tip of the LED is located at the focal point of the parabolic surface. Thus, the side-emitted light 120 that strikes the inner face 100 of the parabolic portion 92 reflects to form a second parallel beam of light 122.

Figure 7D:
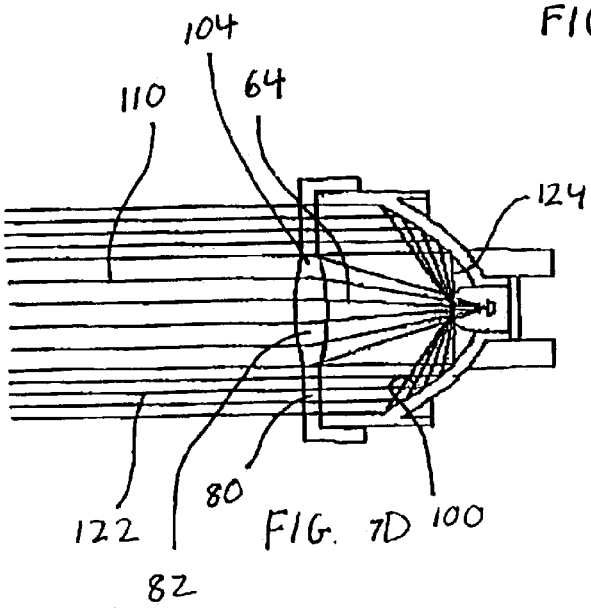
FIG. 7D is a side elevational view of a forward portion of the flashlight used in the flashlight depicted in FIG. 2, depicting both the directed LED light and a significant portion of the emitted non-directional light being made parallel.

As seen in FIG. 7D, preferably the parabolic inner face, 100 is sized and positioned such that the second parallel beam 122 is parallel to the first parallel beam 110. Likewise, preferably the parabolic inner face 100 is sized and positioned such that light emitted in a direction normal 124 to the center of the directed beam reflects off the inner face and then passes through the circular flat portion 80 immediately outside the periphery 104 of the convergent-lens portion 82. Thus, most of the light produced by the LED, and preferably more than 90% of the light, will be directed in a parallel, useful beam.

Because such a large portion of the generated light is in the useful beam, the total amount of light emitted by the LED's filament (which is typically substantially less than that of an incandescent bulb) is adequate to produce a useful beam. Furthermore, the LED uses substantially less energy, extending battery life of the flashlight by a substantial margin, preferably to at least 50 hours with two AA batteries. This is roughly 20 times the battery life of common flashlights. Even after extended storage, the LED can continue to function on the reduced battery power that is available. Furthermore, because LEDs are not as fragile and short lived as incandescent bulbs, the flashlight preferably has an effectively infinite bulb life (up to approximately 100,000 hours) with high durability and little likelihood of LED failure due to rough handling.

Returning to FIGS. 2, 4A and 4B, the parabolic portion 92 is supported with respect to the circuit board 96 by the support legs 94. The LED 60 is mounted directly in the circuit board, and thus the support legs and circuit board contribute to holding the LED in position with respect to the parabolic portion and the lens 14. The circuit board and its associated circuitry 98 provide the power to energize the LED.

The circuit board is sized and otherwise configured to be received within a holding-cavity 128 in the body portion 18. The power is provided to the circuit board through lead wires 130 connecting to contacts 132 in the body portion 18. The body portion includes compartments 134 for holding two batteries 136, where the contacts are positioned in the compartments to contact the batteries.

The circuit including the two batteries 136, the circuit board 96 and its associated circuitry 98 and the LED 60 also passes through two contacts 140 on the switch assembly 20. When a person depresses the rubber cap 52, which extends through the rearward facing orifice 44, the switch assembly alternates between opening and closing the circuit, thereby alternating the flashlight between an "on" and an "off" state.

From the foregoing description, it will be appreciated that the present invention provides a durable flashlight, which is water and shock resistant, configured to provide an effective useful beam for an extended period, particularly after extended storage. While a particular form of the invention has been illustrated and described, it will be apparent that various modifications can be made without departing from the spirit and scope of the invention. Thus, although the invention has been described in detail with reference only to the preferred embodiments, those having ordinary skill in the art will appreciate that various modifications can be made without departing from the invention. Accordingly, the invention is not intended to be limited, and is defined with reference to the following claims.

We claim:

1. A flashlight, comprising:

an illuminator assembly including an LED, a printed circuit board, a flange, and a parabolic reflector;

a lens having a convergent portion, a nonconvergent portion, and a lens flange, wherein the convergent portion is characterized by a focal point; and a housing conformingly receiving the illuminator assembly so as to contain the illuminator assembly within the housing;

wherein associated circuitry is mounted on the printed circuit board, the associated circuitry configured to provide power to the LED;

wherein the LED has a light emitting element, a parabolic micro-reflector and a transparent tip, the LED being mounted in the printed circuit board and configured to emit light from its light emitting element and produce by reflection from the parabolic micro-reflector a divergent beam of light that is characterized by an optical directivity angle extending from a vertex point, and also to produce additional light extending in a direction outside of the divergent beam of light and emanating from the tip of the LED;

wherein the parabolic reflector is connected to the printed circuit board such that the focal point of the parabolic reflector coincides with the transparent tip;

wherein the flange is configured to engage the lens flange to position the LED so that the light emitting element is positioned at the focal point of the convergent portion and the divergent beam is centered on the focal center point of the convergent portion;

wherein substantially all of the divergent beam of light from the LED passes through the convergent lens to emerge in a first beam of parallel light; and wherein the parabolic reflector reflects at least a portion of the additional light into a second beam of parallel light that is parallel to the first beam of parallel light and extending through the nonconvergent portion of the lens.

2. The flashlight of claim 1, and further comprising a body portion defining one or more battery compartments configured to receive one or more batteries, wherein:

the illuminator assembly is conformingly received by the body portion; and the housing conformingly receiving the body portion so as to contain the body portion within the housing.

3. The flashlight of claim 1 wherein:

the portion of the lens that is convergent comprises a focal center point and is characterized by a convergence diameter D, wherein the distance between the focal point and the focal center point defines a focal distance L, and wherein the relationship between the convergence diameter D, the focal distance L, and the optical directivity angle A is described by the relation $D \geqq 2L \tan(A/2)$.

4. The flashlight of claim 1, wherein the directivity angle is about 20°.

5. The flashlight of claim 1, wherein the non-convergent portion of the lens surrounds the convergent portion of the lens.

6. The flashlight of claim 1, and further comprising:

a switch;

at least one battery compartment configured to hold at least one battery, the battery compartment having contacts that are connected in a circuit that includes the LED and the switch such that the switch can close and open the circuit to energize and deenergize the LED when the battery is installed in the battery compartment; and a housing configured to house the LED, the lens, the switch and the battery compartment.

7. A flashlight comprising:

a lens having a convergent portion, a nonconvergent portion, and a lens flange, wherein the convergent portion is characterized by a focal point;

an illuminator assembly including an LED, a flange, and a parabolic reflector, the LED having a light emitting element and a transparent tip, and the LED connected to a structure containing circuitry connecting the LED with a battery, wherein the LED emits a divergent beam of light that is characterized by an optical directivity angle extending from a vertex point, and wherein the LED emits additional light extending in a direction outside of the divergent beam of light and emanating from the tip of the LED; and a housing conformingly receiving the illuminator assembly so as to contain the illuminator assembly within the housing, wherein the parabolic reflector is connected to the circuitry-containing structure such that the focal point of the parabolic reflector coincides with the transparent tip of the LED, wherein the flange is configured to engage the lens flange to position the LED so that the light emitting element is positioned at the focal point of the convergent portion of the lens and the divergent beam of light is centered on the focal center point of the convergent portion of the lens, wherein a beam of light from the LED passes through the convergent portion of the lens to emerge in a first beam of parallel light; and wherein the parabolic reflector reflects at least a portion of the additional light into a second beam of parallel light that is parallel to the first beam of parallel light and extends through the nonconvergent portion of the lens.

8. The flashlight of claim 7, wherein the non-convergent portion of the lens surrounds the convergent portion of the lens.

9. The flashlight of claim 7, and further comprising:

a switch;

at least one battery compartment configured to hold at least one battery, the battery compartment having at least one contact that is connected in a circuit that includes the LED and the switch such that the switch can close and open the circuit to energize and deenergize the LED when the battery is installed in the battery compartment; and a housing configured to house the LED, the lens, the switch and the battery compartment.

10. The flashlight of claim 7, wherein the divergent beam of light passes substantially through the convergent portion of the lens to form a first parallel beam of light.

11. A flashlight comprising:

an illuminator assembly including an LED, a flange, and a parabolic reflector, a lens having a convergent portion, a nonconvergent portion, and a lens flange, wherein the convergent portion is characterized by a focal point; and a housing conformingly receiving the illuminator assembly so as to contain the illuminator assembly within the housing;

wherein the LED has a light emitting element, a parabolic micro-reflector and a transparent tip, and the LED is mounted on a circuit board and configured to emit light from its light emitting element and produce by reflection from the parabolic micro-reflector a divergent beam of light that is characterized by an optical directivity angle extending from a vertex point, and also to produce additional light extending in a direction outside of the divergent beam of light and emanating from the tip of the LED;

wherein the parabolic reflector is positioned such that the focal point of the parabolic reflector coincides with the transparent tip of the LED;

wherein the flange is configured to engage the lens flange to position the LED so that the light emitting element is positioned at the focal point of the convergent portion of the lens and the divergent beam is centered on the focal center point of the convergent portion of the lens;

wherein the divergent beam of light from the LED passes through the convergent lens to emerge in a first beam of parallel light; and wherein the parabolic reflector reflects at least a portion of the additional light into a second beam of parallel light that is parallel to the first beam of parallel light and extending through the nonconvergent portion of the lens.

12. The flashlight of claim 11, wherein the non-convergent portion of the lens surrounds the convergent portion of the lens.

13. The flashlight of claim 11, and further comprising:

a switch;

at least one battery compartment configured to hold at least one battery, the battery compartment having at least one contact that is connected in a circuit that includes the LED and the switch such that the switch can close and open the circuit to energize and deenergize the LED when the battery is installed in the battery compartment; and a housing configured to house the LED, the lens, the switch and the battery compartment.

14. A flashlight comprising:

a lens having a convergent portion, a nonconvergent portion, and a lens flange, wherein the convergent portion is characterized by a focal point;

an illuminator assembly including a LED, a flange, a mounting structure and a parabolic reflector, the LED characterized by emitting a divergent beam of light, the LED and the parabolic reflector connected to the mounting structure, and the focal point of the parabolic reflector coinciding with a light emitting area of the LED;

a housing conformingly receiving the illuminator assembly so as to contain the illuminator assembly and the lens within the housing;

wherein the flange is configured to engage the lens flange to position the LED so that the light emitting area of the LED is positioned at the focal point of the convergent portion of the lens, wherein the divergent beam of light from the LED passes through the convergent portion of the lens to emerge in a first beam of parallel light, and wherein the parabolic reflector reflects light from the divergent light emitting area of the LED into a second beam of parallel light that is parallel to the first parallel beam and exits through the nonconvergent portion of the lens.

15. The flashlight of claim 14, wherein the non-convergent portion of the lens surrounds the convergent portion of the lens.

16. The flashlight of claim 14, and further comprising:

a switch;

at least one battery compartment configured to hold at least one battery, the battery compartment having at least one contact that is connected in a circuit that includes the LED and the switch such that the switch can close and open the circuit to energize and deenergize the LED when the battery is installed in the battery compartment; and a housing configured to house the LED, the lens, the switch and the battery compartment.

17. The flashlight of claim 14, wherein the divergent beam of light passes substantially through the convergent portion of the lens to form a first parallel beam of light.

* * * * *